US006749331B1

(12) United States Patent
Hughes

(10) Patent No.: US 6,749,331 B1
(45) Date of Patent: Jun. 15, 2004

(54) FLUID DRIVEN ROTARY AGITATOR WITH SUCTION CONDUIT

(75) Inventor: John E. Q. Hughes, Chandler, AZ (US)

(73) Assignee: Hughes Product Designs, Chandler, AZ (US)

( * ) Notice: Subject to any disclaimer, the term of this patent is extended or adjusted under 35 U.S.C. 154(b) by 0 days.

(21) Appl. No.: 10/109,355

(22) Filed: Mar. 28, 2002

(51) Int. Cl.[7] ..... B01F 7/16
(52) U.S. Cl. ..... 366/191; 366/281; 366/308
(58) Field of Search ..... 366/191, 270, 366/308, 244–251, 262–265, 281–284

(56) References Cited

U.S. PATENT DOCUMENTS 1,167,536 A * 1/1916 Tokheim ..... 366/191
3,559,962 A * 2/1971 Enssle et al. ..... 366/308
4,083,653 A * 4/1978 Stiffler ..... 416/142
4,184,778 A * 1/1980 Terrels ..... 366/250
4,501,500 A * 2/1985 Terrels ..... 366/250
5,193,908 A * 3/1993 Rescorla et al. ..... 366/163.1
5,362,148 A * 11/1994 Lehrke et al. ..... 366/191
5,941,636 A * 8/1999 Lu ..... 366/249

* cited by examiner

*Primary Examiner*—Charles E. Cooley
(74) *Attorney, Agent, or Firm*—Parsons & Goltry; Michael W. Goltry; Robert A. Parsons

(57) ABSTRACT

Disclosed is a mixer consisting of a receptacle and an agitator capable of agitating material in the receptacle and conducting material to and from the receptacle. The agitator includes an engine, at least one agitator element disposed in the receptacle, and a drive shaft coupling the engine to the agitator element. The drive shaft carries a conduit, which is capable of conducting material to and from the receptacle. The conduit has an open proximal extremity disposed outboard of the receptacle and an open distal extremity disposed in the receptacle. The engine consists of radial vanes attached to the drive shaft and the drive shaft rotated to a chassis having a chamber substantially enclosing the vanes, an inlet leading to the chamber and an outlet leading from the chamber, in which the drive shaft is made to rotate in response to a flow of fluid acting on the vanes passing through the chamber from the inlet to the outlet.

10 Claims, 5 Drawing Sheets

38
30
34
100
105
90
40
91
22
33
32
35

22
40
100
34
105
30

24
30
40
22
33
34
30
90
91
40
22
33

10
38
34
30
100
10
105
90
90
40

22
33

FLUID DRIVEN ROTARY AGITATOR WITH SUCTION CONDUIT

FIELD OF THE INVENTION

This invention relates to mixers and to apparatus and methods for mixing slurries and high purity chemical solutions.

BACKGROUND OF THE INVENTION

Industries such as the semiconductor industry, the pharmaceutical industry, the paint industry, to name but a few, use mixers for mixing various kinds of slurries and other mixtures. Given the different mixing needs among the various industries, skilled artisans have devoted considerable effort developing efficient and highly effective mixers. Nevertheless, existing mixers are expensive, complicated to build and hard to clean. Existing mixers, especially those used for mixing highly pure mixtures, are also difficult to use, especially in applications in which mixed solutions and slurries must be transferred to and from mixing receptacles and when mixing processes require the introduction of various constituents at different times during the mixing process. Given these and other deficiencies in the art, the need for certain new and useful improvements is evident.

SUMMARY OF THE INVENTION

The above problems and others are at least partially solved and the above purposes and others realized in various new and improved mixing apparatus and methods. In one preferred apparatus embodiment, provided is a receptacle and an agitator capable of agitating material in the receptacle and conducting material to and from the receptacle. The agitator consists of an engine, at least one agitator element disposed in the receptacle, and a drive shaft coupling the engine to the agitator element. The engine drives the drive shaft, which transfers the mechanical power from the engine to the agitator element. The agitator is furnished with a conduit, which is associated with the drive shaft. The conduit is capable of conducting material to and from the receptacle, and has an open proximal extremity disposed outboard of the receptacle and an open distal extremity disposed in the receptacle. The engine consists of radial vanes attached to the drive shaft. The drive shaft is rotated to a chassis, which has a chamber that substantially encloses the vanes, an inlet leading to the chamber and an outlet leading from the chamber. The drive shaft is made to rotate in response to a flow of fluid acting on the vanes passing through the chamber from the inlet to the outlet. The chassis supports an adjustable baffle, which is capable of being adjusted for regulating a fluid flow through the chamber at one of the inlet and the outlet. A fixture secures the engine to the receptacle, and the agitator element consists of a collar attached to the drive shaft and radial blades pivoted to the collar. Preferably, a fluid pump is coupled in fluid communication to the open proximal extremity of the conduit, facilitating material transfer through the conduit.

Another preferred apparatus embodiment of the invention consists of a receptacle, an engine, at least one agitator element disposed in the receptacle, a drive shaft coupling the engine to the agitator element, and a conduit associated with the drive shaft that is capable of conducting material to and from the receptacle. The conduit has an open proximal extremity disposed outboard of the receptacle and an open distal extremity disposed in the receptacle. The engine drives the drive shaft, which transfers the mechanical power from the engine to the agitator element. The engine consists of radial vanes attached to the drive shaft. The drive shaft is rotated to a chassis, which has a chamber that substantially encloses the vanes, an inlet leading to the chamber and an outlet leading from the chamber. The drive shaft is made to rotate in response to a flow of fluid acting on the vanes passing through the chamber from the inlet to the outlet. The chassis supports an adjustable baffle, which is capable of being adjusted for regulating a fluid flow through the chamber at one of the inlet and the outlet. A fixture secures the engine to the receptacle, and the agitator element consists of a collar attached to the drive shaft and radial blades pivoted to the collar. Preferably, a fluid pump is coupled in fluid communication to the open proximal extremity, facilitating material transfer through the conduit.

Yet another preferred apparatus embodiment of the invention consists of a receptacle, an engine, at least one agitator element disposed in the receptacle, and a drive shaft coupling the engine to the agitator element. The engine drives the drive shaft, which transfers the mechanical power from the engine to the agitator element. In this embodiment, the engine consists of radial vanes attached to the drive shaft, in which the drive shaft is rotated to a chassis having a chamber substantially enclosing the vanes, an inlet leading to the chamber and an outlet leading from the chamber. The drive shaft is made to rotate in response to a flow of fluid acting on the vanes passing through the chamber from the inlet to the outlet. The agitator is furnished with a conduit, which is associated with the drive shaft. The conduit is capable of conducting material to and from the receptacle, and has an open proximal extremity disposed outboard of the receptacle and an open distal extremity disposed in the receptacle. The chassis supports an adjustable baffle, which is capable of being adjusted for regulating a fluid flow through the chamber at one of the inlet and the outlet. A fixture secures the engine to the receptacle, and the agitator element consists of a collar attached to the drive shaft and radial blades pivoted to the collar. Preferably, a fluid pump is coupled in fluid communication to the open proximal extremity, facilitating material transfer through the conduit.

Yet still another preferred apparatus embodiment of the invention consists of an engine, at least one agitator element, a drive shaft coupling the engine to the agitator element, and a conduit associated with the drive shaft that is capable of conducting material therethrough. The engine drives the drive shaft, which transfers the mechanical power from the engine to the agitator element. The conduit has an open proximal extremity disposed adjacent the engine and an open distal extremity disposed adjacent the agitator element. The engine consists of radial vanes attached to the drive shaft. The drive shaft is rotated to a chassis, which has a chamber that substantially encloses the vanes, an inlet leading to the chamber and an outlet leading from the chamber. The drive shaft is made to rotate in response to a flow of fluid acting on the vanes passing through the chamber from the inlet to the outlet. The chassis supports an adjustable baffle, which is capable of being adjusted for regulating a fluid flow through the chamber at one of the inlet and the outlet. A fixture is also provided, which is capable of securing the engine to a receptacle. The agitator element consists of a collar attached to the drive shaft and radial blades pivoted to the collar. Preferably, a fluid pump is coupled in fluid communication to the open proximal extremity, facilitating material transfer through the conduit.

Yet a further preferred apparatus embodiment of the invention consists of, an engine, at least one agitator element, and a drive shaft coupling the engine to the agitator element. The engine drives the drive shaft, which transfers the mechanical power from the engine to the agitator element. In this embodiment, the engine consists of radial vanes attached to the drive shaft, in which the drive shaft is rotated to a chassis having a chamber substantially enclosing the vanes, an inlet leading to the chamber and an outlet leading from the chamber. The drive shaft is made to rotate in response to a flow of fluid acting on the vanes passing through the chamber from the inlet to the outlet. The agitator is furnished with a conduit, which is associated with the drive shaft. The conduit is capable of conducting material therethrough, and has an open proximal extremity disposed adjacent the engine and an open distal extremity disposed adjacent the agitator element. The chassis supports an adjustable baffle, which is capable of being adjusted for regulating a fluid flow through the chamber at one of the inlet and the outlet. A fixture is also provided, which is capable of securing the engine to a receptacle. The agitator element consists of a collar attached to the drive shaft and radial blades pivoted to the collar. Preferably, a fluid pump is coupled in fluid communication to the open proximal extremity, facilitating material transfer through the conduit.

The invention also contemplates associated apparatus embodiments and methods.

BRIEF DESCRIPTION OF THE DRAWINGS

Referring to the drawings.

DETAILED DESCRIPTION OF PREFERRED EMBODIMENTS

This disclosure presents teachings of a novel mixer and agitator in addition to associated preferred apparatus and method embodiments. In general, the invention constitutes a receptacle and an agitator capable of agitating material in the receptacle and conducting material to and from the receptacle. The agitator consists of an engine, at least one agitator element disposed in the receptacle, and a drive shaft coupling the engine to the agitator element. The engine drives the drive shaft, which transfers the mechanical power from the engine to the agitator element. The agitator is furnished with a conduit, which is associated with the drive shaft. The conduit, which is part of the drive shaft, is capable of conducting material to and from the receptacle, and has an open proximal extremity disposed outboard of the receptacle and an open distal extremity disposed in the receptacle. The engine consists of radial vanes attached to the drive shaft. The drive shaft is rotated to a chassis, which has a chamber that substantially encloses the vanes, an inlet leading to the chamber and an outlet leading from the chamber. The drive shaft is made to rotate in response to a flow of fluid acting on the vanes passing through the chamber from the inlet to the outlet. The chassis supports an adjustable baffle, which is capable of being adjusted for regulating a fluid flow through the chamber at one of the inlet and the outlet. A fixture secures the engine to the receptacle, and the agitator element consists of a collar attached to the drive shaft and radial blades pivoted to the collar. Preferably, a fluid pump is coupled in fluid communication to the open proximal extremity of the conduit, facilitating material transfer to and from the receptacle through the conduit.

Figure 1:
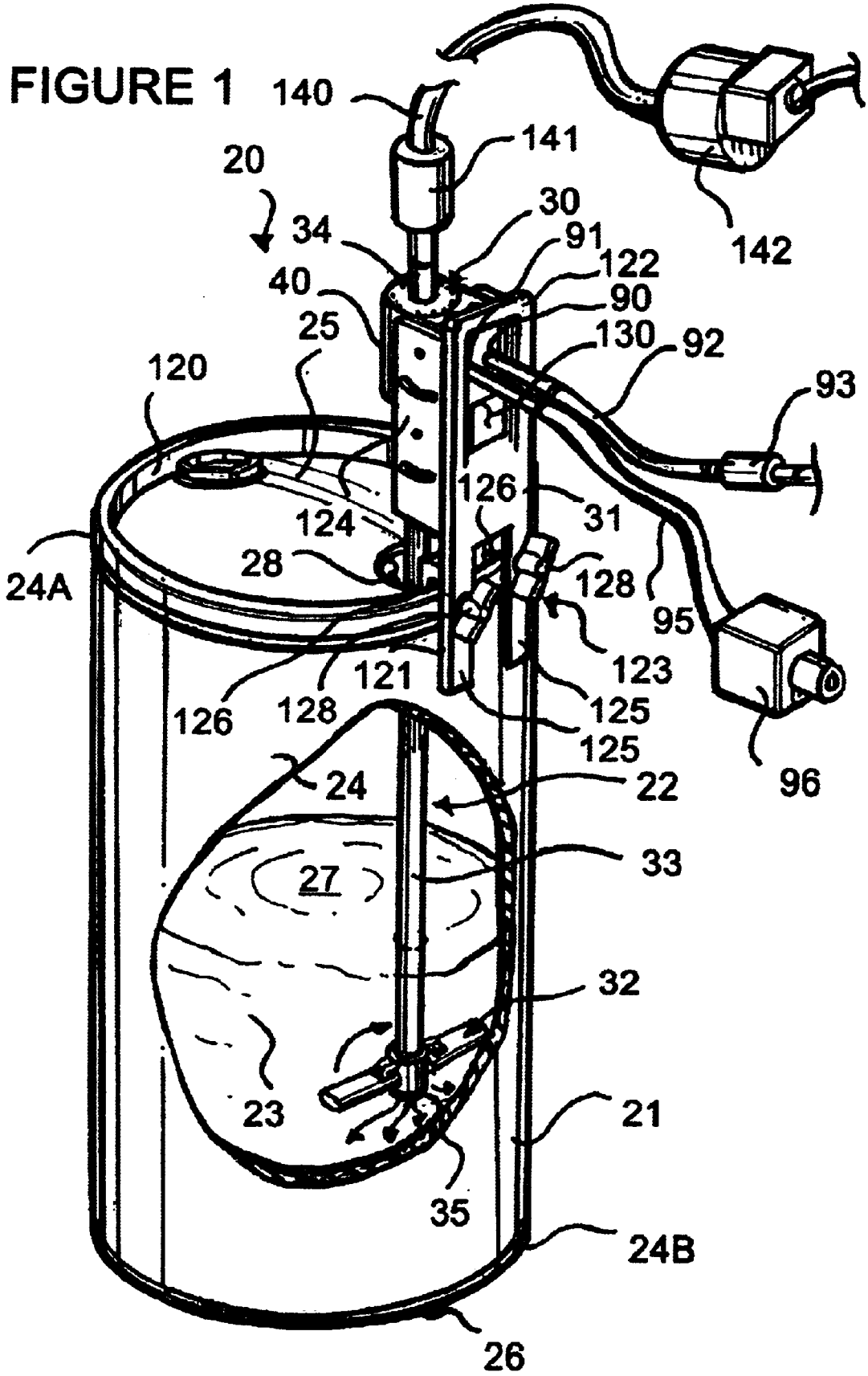
FIG. 1 is an isometric view of a mixer constructed in accordance with the principle of the instant invention, the mixer including a receptacle and an agitator capable of agitating material in the receptacle and conducting material to and from the receptacle, the agitator consisting of an engine attached to a fixture secured to the receptacle, an agitator element disposed in the receptacle, and a drive shaft coupling the engine to the agitator element.

Turning now to the drawings, in which like reference characters indicate corresponding elements throughout the several views, attention is first directed to FIG. 1 in which is seen a mixer, embodying the principle of the instant invention, generally indicated by the reference character 20 including a receptacle 21 and an agitator 22 capable of agitating material 23 in receptacle 21 and conducting material to and from receptacle 21. Material 23 in receptacle 21 is a slurry, a chemical mixture, paint, primer, pasta sauce, etc., or any other mixture requiring mixing, including various forms of high purity chemical mixture, slurries and other solutions, etc. Receptacle 21 is constructed of stainless steel or other selected metal or metal composite, plastic, ceramic or the like, and is composed of an upstanding continuous sidewall 24 having opposing upper and lower ends 24A, 24B. Receptacle 20 further includes a substantially horizontal top 25 affixed to end 24B and a substantially horizontal bottom 26 affixed to end 24B. Top 25 and bottom 26 cooperate with sidewall 24 to form a fluid impervious chamber 27 of receptacle 21, in which material 23 is held and into which agitator 22 extends. Top 25 is fashioned with an opening or bunghole 28, through which agitator 22 extends into chamber 27.

Figures 2, 3, 4, 5, 6:
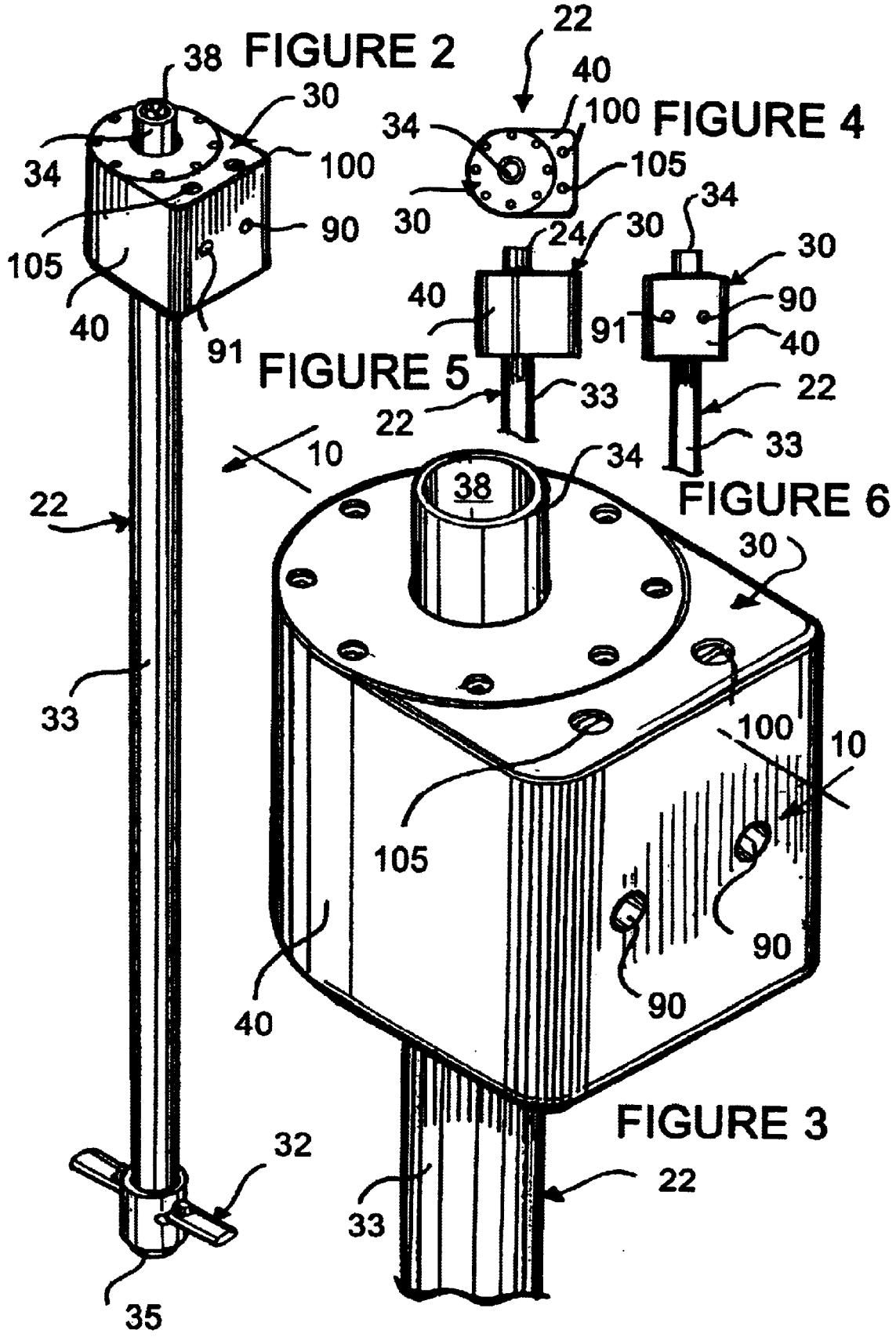
FIG. 2 is an isometric view of the agitator of FIG. 1.
FIG. 3 is an enlarged isometric view of the engine depicted in FIG. 1.
FIG. 4 is a top plan of the engine depicted in FIG. 1.
FIG. 5 is a side elevation of the engine depicted in FIG. 1, the opposing side elevation being a substantial mirror image thereof.
FIG. 6 is a front elevation of the engine depicted in FIG. 1.

Further to FIG. 1, agitator 22 consists of an engine 30, an agitator element 32 and a drive shaft 33 coupling engine to agitator element 32. In the embodiment depicted in FIG. 1, a stand/fixture 31 secures engine to receptacle 21, and agitator element 32 is disposed in chamber 27 of receptacle 21. When activated, engine 30 provided a mechanical force, which is transferred to agitator element 32 via drive shaft 33 agitating material 23. In this case, engine 30 rotates drive shaft 33, which rotational force drive shaft 33 supplies to agitator element 32 effecting a mixing of material 23. Drive shaft 33 is elongate and substantially rigid, and is constructed of stainless steel or other selected metal or metal composite material, plastic, etc. In FIG. 1, drive shaft 33 extends through opening 28 and includes a proximal extremity/end 34 disposed outboard of receptacle 21 and a distal extremity/end 35 disposed in chamber 27 of receptacle 21 and, as illustrated, in material 23. Engine 30 is attached to drive shaft 33 proximate end 34 and is disposed outboard of receptacle 21. Agitator element 32 is attached to drive shaft 33 proximate end 35 and is disposed in chamber 27 and in material 23. Although one agitator element is shown, more can be employed attached to drive shaft 33. FIG. 2 is an isometric view of agitator 22, illustrating engine 30, agitator element 32 and drive shaft 33 including ends 34,35 thereof. FIG. 3 is an enlarged isometric view of engine 30 and end 34 of drive shaft 33. FIG. 4 is a top plan of engine 30, FIG. 5 is a side elevation of engine 30 and end 34 of shaft. 33, and FIG. 6 is a front elevation of engine 30 and end 34 of shaft 33.

Regarding FIG. 2, drive shaft 33 associates with a conduit 38 that is capable of conducting material therethrough, for instance, to and from receptacle 21 (FIG. 1). Ends 34,35 of drive shaft 33 are open and lead to a conduit 38 extending through and defined by drive shaft 33 from end 34 to end 35. Conduit 38 is thus carried by drive shaft 33. Conduit 38 can be formed with, associated with or otherwise attached to drive shaft either interiorly or exteriorly in other ways depending on particular needs, applications and construction preferences. As will be explained later in this specification, conduit 38 allows material to be transferred therethrough to and from receptacle 21 (FIG. 1). It will be appreciated from the drawings that drive shaft 33 is essentially a long, rigid hollow tube having opposing open ends. This is a simple and inexpensive arrangement for not only providing a drive shaft but also providing a conduit as herein described.

Figure 10:
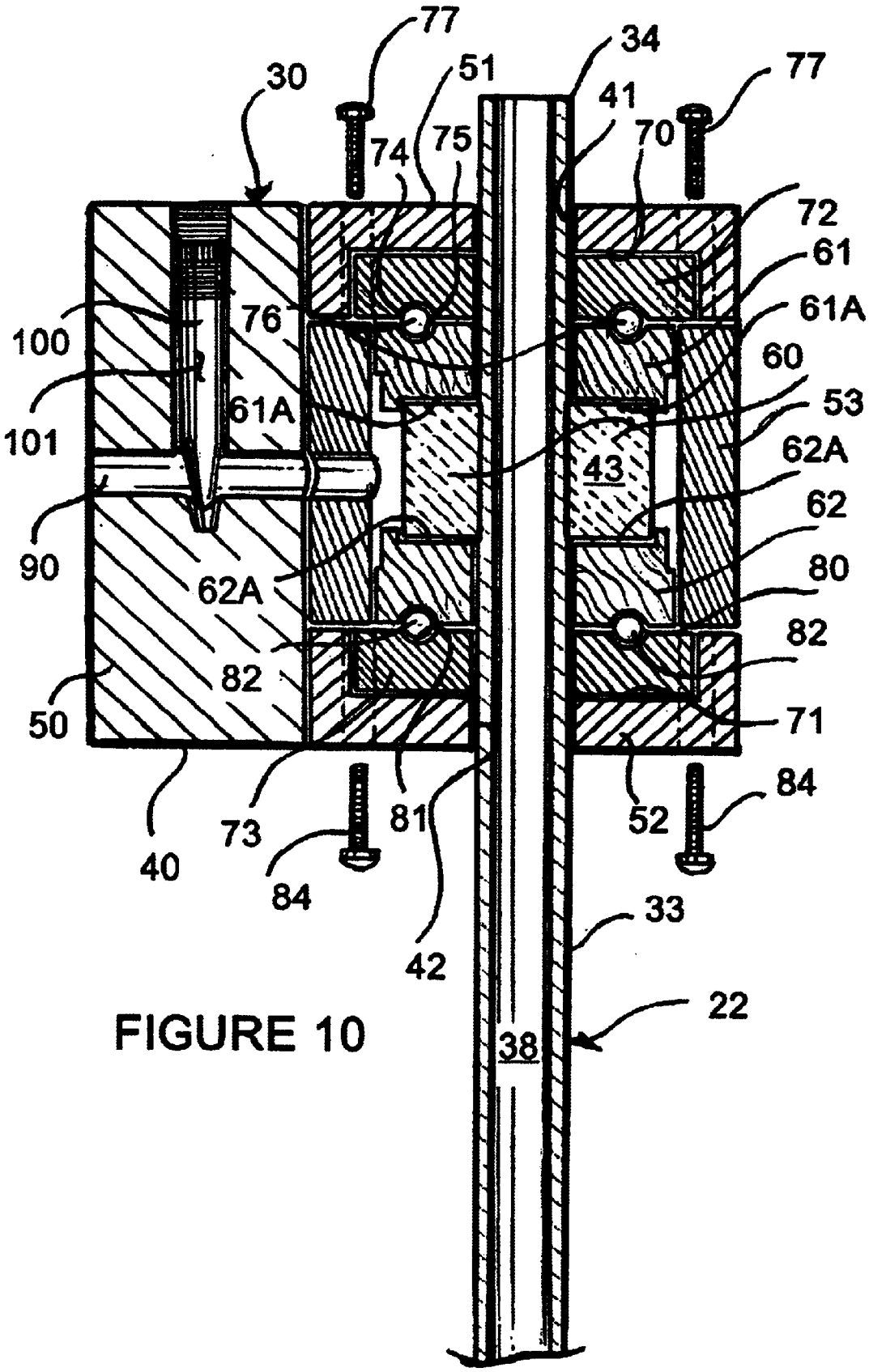
FIG. 10 is vertical sectional view taken along line 10—10 of FIG. 3.
Figure 11:
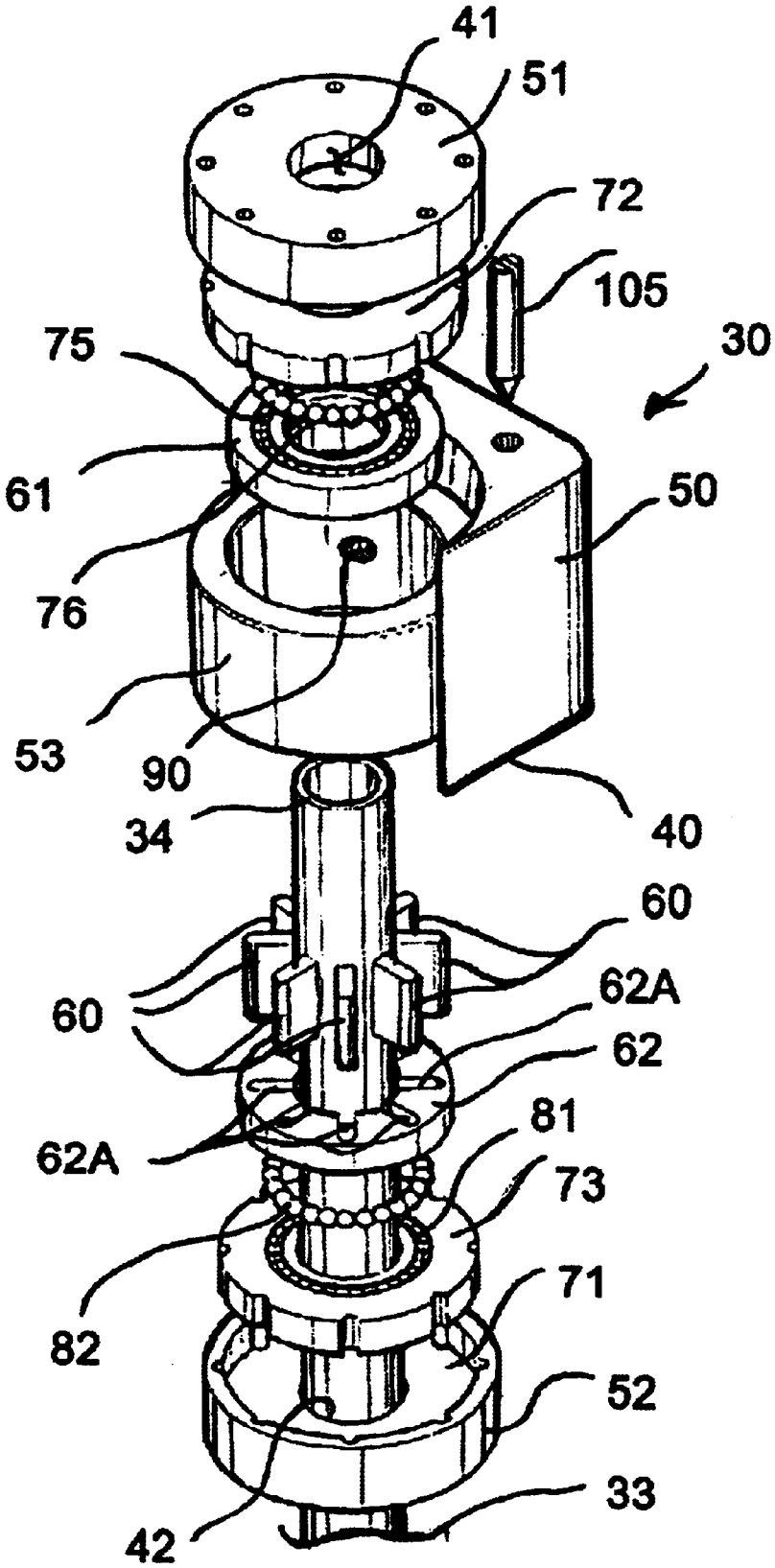
FIG. 11 is an exploded isometric view of the engine of FIG. 1.

Considering FIGS. 10 and 11 in relevant part, engine 30 consists of a chassis 40 having opposing coaxial openings 41,42 leading to a chamber 43 bound by chassis 40. Drive shaft 33 is rotated to engine 30, and extends into and through openings 41,42 and chamber 43. Drive shaft 33 thus attaches to engine 30 and rotates in openings 41,42 and chamber 43 in response to an impulse applied to drive shaft 33 by engine 30. In general, engine 30 is disposed between ends 34,35 of drive shaft 33, and, more particularly, is positioned adjacent end 34, which is located somewhat outboard of engine 30. Chassis 40, which is preferably constructed of stainless steel or other selected metal or metal composite, plastic, ceramic or the like, consists of a base 50, opposing parallel caps 51,52 and a continuous sidewall 53. Cap 51 supports opening 41, and cap 52 supports opening 42. Sidewall 53 is disposed between caps 51,52, which are secured at either end of base 50. Caps 51,52 are preferably secured to base 50 with fasteners such as screws or bolts or the like, and welding or adhesive attachment can be used as well, including integral formation. Caps 51,52 and sidewall 53 cooperate together to define chamber 43, at which are disposed vanes 60 and opposing parallel couplings 61,62. Sidewall 53 encircles vanes 60 and couplings 61,62, as illustrated. Sidewall 53 is secured in place and preferably to base 50 with fasteners such as screws or bolts or the like, and welding or adhesive attachment can be used as well, including integral formation. Caps 51,52 can be secured directly to sidewall 53 if desired. Vanes 60 are radially disposed at equally spaced intervals and are secured to and extend away from drive shaft 33. Preferably, vanes 60 are made of stainless steel or other selected metal or metal composite, plastic or the like, and are secured to drive shaft 33 with welding, and yet adhesive can be used if desired, as well as mechanical fasteners such as screws, rivets, etc. Vanes 60 can also be integrally formed with drive shaft 33, if desired.

Couplings 61,62 are fashioned of stainless steel or other selected metal or metal composite, plastic, ceramic or the like, and have central coaxial openings through which drive shaft 33 extends. Couplings 61,62 encircle and, in accordance with a preferred embodiment, secure tightly against drive shaft 33. Couplings 61,62 are substantially identical and attach to the opposing ends of vanes 60. Couplings 61,62 are fashioned with blind radial recesses or slots, which are dimensioned and positioned appropriately to receive therein and secure the opposing upper and lower ends of vanes 60. The recesses of coupling 61 are denoted by the reference numeral 61A (FIG. 1), and the recesses of coupling 62 are denoted by the reference numeral 62A. Couplings 61,62 can be attached to the ends of vanes 60 in other ways in accordance with the skill attributed to those of ordinary skill in the art.

A bearing/journaled attachment exists between couplings 61,62 and chassis 40, permitting shaft 33, the attached vanes 60 and couplings 61,62 to rotate together relative to the remaining structure of engine 30. In this specific embodiment as best seen in FIG. 10, caps 51,52 are fashioned with inwardly directed and opposing recesses 70,71, into which are disposed supports 72,73, respectively. Supports 72,73 are fashioned of stainless steel or other selected metal or metal composite, plastic, ceramic or the like, encircle drive shaft 33, and have central coaxial openings through which drive shaft 33 extends and are made to permit drive shaft 33 to rotate relative thereto. Support 72 carries an inwardly directed annular race 74, which faces chamber 43 and an opposing annular race 75 carried by coupling 61. An annular arrangement of ball bearings 76 is captured by and between races 74,75, permitting coupling 61 to rotate relative to support 72. Support 72 is fixed to cap 51 with fasteners 77, which, in this specific embodiment, are arranged annularly and composed of threaded fasteners (screws or bolts) and yet other types of fasteners can be used if desired including rivets, one or more tongue and groove or male and female attachment features, adhesive, etc., and even press fitting or welding or adhesive, etc. Support 72 and cap 51 can be integrally formed or otherwise provided as a single component, if desired. Like support 72, support 73 also carries an inwardly directed annular race 80, which faces chamber 43 and an opposing annular race 81 carried by coupling 62. An annular arrangement of ball bearings 82 is captured by and between races 80,81, permitting coupling 62 to rotate relative to support 73. Support 73 is fixed to cap 52 with fasteners, which are arranged annularly and are composed of threaded fasteners 84 (screws or bolts) and yet other types of fasteners can be used if desired including rivets, one or more tongue and groove or male and female attachment features, adhesive, etc., and even press fitting or welding or adhesive, etc. Support 73 and cap 52 can be integrally formed or otherwise provided as a single component, if desired. The arrangement of supports 72,73 and the described races and annular ball bearing arrangements constitute a preferred way of permitting shaft 33, the attached vanes 60 and couplings 61,62 to rotate together relative to the remaining structure of engine 30. Other bearing/journaled attachment structure can be used, if desired.

Referring to FIGS. 2, 3 and 6, chassis 40 is fashioned with an inlet 90 and an outlet 91, both of which communicate with chamber 43 (FIG. 10). Inlet 90 and outlet 91 are disposed in a spaced-apart and parallel relationship to one another, and yet other orientations can be used consistent with this disclosure. Looking back to FIG. 10, inlet 90 extends through base 50 and sidewall 53 as does outlet 91 (not shown), and each at either side of drive shaft 33. In a particular embodiment and with reference to FIG. 1, inlet 90 is attached to a line 92 that is capable of conducting fluid from a fluid source to inlet 90. A pump 93 is coupled to line 92, which when activated forcibly moves the fluid through line 92 and to chamber 43 (FIG. 10) by way of inlet 90 introducing a flow of fluid through chamber 43. Fluid forcibly moved into chamber 43 through inlet 90 exits through outlet 91. As the fluid flows through chamber 43 from inlet 90 to outlet 91, it interacts with vanes 60, which causes drive shaft 33 to rotate rotating agitator element 32, which agitates material 23 effecting a mixing thereof. The fluid is preferably a selected gas such as air, nitrogen, etc., and pump 93 is any suitable air pump. The fluid can also be a selected fluid such as oil or the like, in which case pump 93 is a peristaltic pump or any other suitable fluid pump. Preferably, inlet 90 and outlet 91 are associated with a recirculating fluid delivery system, in which one or more pumps forcibly introduce a recirculating fluid flow through chamber from inlet 90 to outlet 91. When pump 93 is active and moving fluid to and through engine 30, engine is considered coupled to a pressured source of fluid. Rather than pump 93 providing a pressured source of fluid, other pressurized sources of fluid can be employed with the invention.

Rather than forcibly exerting fluid into chamber 43 for affecting a fluid flow through chamber 43 for the purpose of imparting rotation to drive shaft 33, fluid can be pulled through chamber 43 for affecting the fluid flow through chamber 43. In a particular embodiment in this regard, outlet 91 is attached to a line 95 that is capable of conducting fluid. A pump 96 is coupled to line 95, which when activated forcibly draws fluid from chamber 43, which is supplied thereto through inlet 90, thus introducing a fluid flow through chamber 43. Thus, fluid is forcibly drawn into chamber 43 from inlet 90 and through chamber 43 and outwardly therefrom through outlet 91 and into line 95 in response to activation of pump 96. As the fluid flows through chamber 43 in this manner, it interacts with vanes 60, which causes drive shaft 33 to rotate rotating agitator element 32, which agitates material 23 effecting a mixing thereof. The fluid is preferably a selected gas such as air, nitrogen, etc., and pump 96 is any suitable air/vacuum pump. The fluid can also be a selected fluid such as oil or the like, in which case pump 96 is a peristaltic pump or any other suitable fluid pump. Preferably in connection with the instant embodiment, inlet 90 and outlet 91 are associated with a recirculating fluid delivery system, in which one or more pumps forcibly introduce a recirculating fluid flow through chamber from inlet 90 to outlet 91. When pump 96 is active and moving fluid through engine 30, engine is considered coupled to a pressured source of fluid. Rather than pump 96 providing a pressured source of fluid, other pressurized sources of fluid can be employed with the invention.

In order to control the rotational speed of drive shaft 33, pump 93 can be of a type that is capable of being adjusted for controlling the speed of the fluid flow. The same also is true for pump 96, if it is employed. Alternatively, and with attention directed to FIG. 10, chassis 40 is furnished with an attached baffle 100 that interacts with inlet 90. In the embodiment depicted in FIG. 10, baffle 100 is elongate and is threadably attached to and within a bore extending through base 50 to inlet 90. By rotating baffle 100, such as with a screwdriver or by hand, baffle 100 is capable of being moved reciprocally between a first position into inlet 90 interfering with the flow of fluid therethrough slowing the fluid flow through chamber 43 and thus slowing the rotation of drive shaft 33, and a second position away from inlet 90 permitting unobstructed fluid flow through inlet 90 establishing an unobstructed fluid flow through chamber 43 maximizing the rotational speed of drive shaft 33. Baffle 100 can be set at various locations between its first and second positions for effecting a desired rotational speed of drive shaft 33, which speed will depend on the mixing action that is desired to be delivered to a mixture by agitator element 32. And so baffle 100 is capable of being adjusted reciprocally between its first and second positions. Although a threaded attachment permits this reciprocal adjustment, baffle 100 can be press fit into bore 101 and movable reciprocally in response to exerting pushing and pulling forces against it. Other ways of mounting baffle 100 for reciprocal adjustment can be employed, if desired. Also, outlet 91 can be furnished with a similar baffle for controlling fluid flow through chamber 43 at outlet 91, which baffle is denoted at 105 in FIGS. 2–4, 6 and 11.

Figure 8:
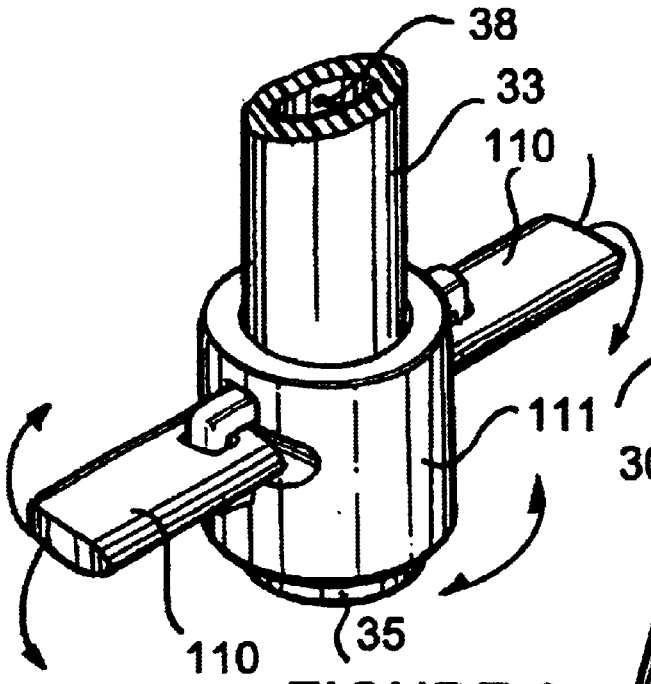
FIG. 8 is an enlarged isometric view of the agitator element of FIG. 1.
Figure 9:
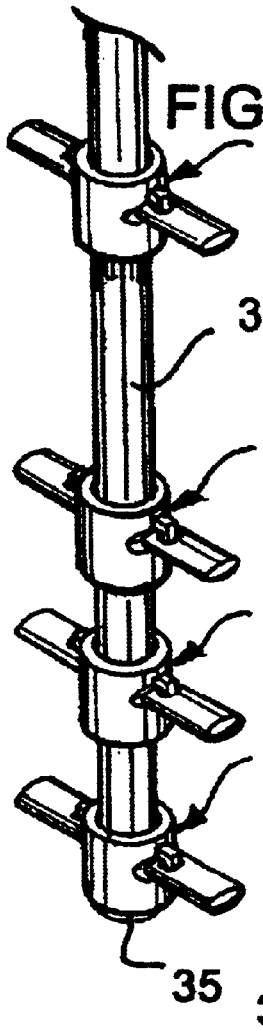
FIG. 9 is an isometric view of a length of the drive shaft of the agitator of FIG. 1 shown as it would appear furnished with a plurality of attached agitator elements.

Referring momentarily to FIG. 8, agitator element 32 is a bladed attachment consisting of blades 110 pivoted to a collar 111 securing drive shaft 33. Collar 111 encircles drive shaft 33 and is secured thereto with one or more fasteners whether one or more threaded fasteners or one or more other suitable fasteners. Adhesive attachment and welding can also be used, if desired. A press fit can also be used. Collar 111 can be integrally formed with drive shaft 33, if desired. Interlocking rings pivotally attach blades 110 to collar 111 as illustrated, and yet other pivoted attachment arrangements can be used in accordance with ordinary skill. Blades 110 pivot between a collapsed position toward one another and an extended position splayed away from one another as illustrated in FIG. 10. In the collapsed position, agitator element 32 is easily inserted through an opening of a receptacle in which material is to be mixed, such as opening 28 of receptacle 21. In response to rotation of shaft 33 and, thus, rotation of agitator element 32, centripetal force introduced to agitator element 32 causes blades 110 to pivot from their collapsed position to their splayed position effecting an efficient mixing of material by blades 110. Although agitator element 32 is disposed proximate end 35 of drive shaft 33 as illustrated in FIGS. 1 and 10 in addition to FIGS. 2 and 7, it can be secured at other locations between ends 34,35 of shaft 33. Also, although one agitator element 32 is set forth, FIG. 9 is instructive of the teaching that a plurality of agitator elements 32 can be employed, if desired.

Figure 7:
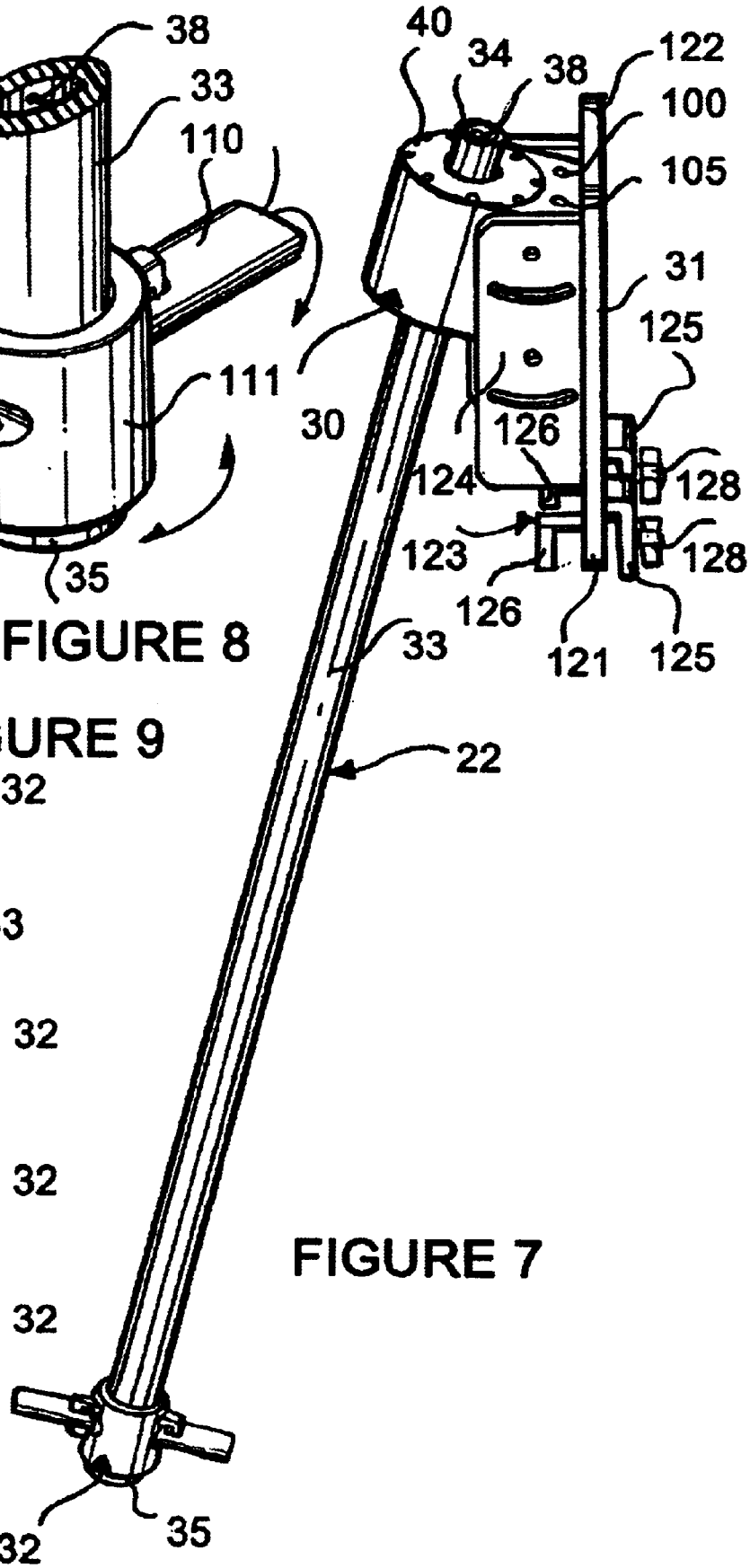
FIG. 7 is an isometric view of the agitator of FIG. 1 attached to the fixture.

Regarding FIG. 1, fixture 31 maintains the engagement between agitator 22 and receptacle 21, which engagement is illustrated and explained throughout this specification. In the particular embodiment set forth in FIG. 1, an upwardly extending rim 120 is attached at end 24A of receptacle 21. Fixture 31 is fashioned from steel or other selected metal or metal composite, plastic, ceramic or other suitably strong and rigid material, and has opposing ends 121,122. A clamp 123 characterizes end 121, which seizes and secures rim 120. Fixture 31 extends upwardly from rim 120 to end 122. Engine 30 is disposed proximate end 122 of fixture 31, and is pivoted to a bifurcated feature 124, which is also illustrated in FIG. 7. Clamp 123 can take on any form that is capable of accommodating and securing rim 120. In the instant embodiment, clamp 123 consists opposing pairs of elements 125,126 that together define a channel capable of receiving therein rim 120. Threaded attachments 128 carried by elements 125 can be tightened against rim 120, securing fixture 31 to rim 120. Reversing this operation detaches fixture 31 from rim 120. Threaded attachments 128 can be carried by elements 126, if desired. Other clamp forms capable of securing fixture 31 to receptacle 21 can be employed. Fixture 31 can also be welded to receptacle 21, if desired, or secured to receptacle 21 in other ways. As seen in FIG. 1, fixture 31 is fashioned with an opening 130 revealing inlet 90 and outlet 91 permitting the coupling thereto of lines 92,95, respectfully. Other ways of securing agitator 22 in place can be used. Agitator 22 can also be secured to a supporting structure other than the receptacle it associates with, if desired.

Further to FIG. 1, it is important to not that end 34 of drive shaft 33, which is disposed somewhat outboard of engine 30 and is open as disclosed, is coupled to a line 140 via a coupling 141, which is rotated to end 34. Coupling 141, which is a type provided by PARKER HANNIFIN of Cleveland, Ohio, effects a fluid coupling with end 34 and yet permits end 34 to rotate, naturally, when drive shaft 33 is driven for rotation by engine 30. Other such types of couplings can be used. Material is capable of being transferred through drive shaft 33 and, more particularly, through conduit 38 (not shown in FIG. 1) of drive, between receptacle 21 and line 140. In this regard, drive shaft 33 serves not only as the mechanism for transferring mechanical power from engine 30 to agitator element 32, but also as the device for allowing material to be transferred between receptacle 21 and line 140. Line 140 can be associated with a fluid pump 142, such as a peristaltic pump or other suitable fluid pump, for pumping material through line 140 to and from receptacle 21. And so material can be transferred to receptacle through conduit 38 of drive shaft 33 for mixing and mixed material can be transferred from receptacle 21 through conduit 38 of drive shaft 33. Line 140 can be attached to any associated device, such as a paint sprayer or other device, for taking mixed material supplied to line 140 from receptacle 21 and using the material for a given application. Pump 142 can actually be part of a paint sprayer or other device. Furthermore, it is important to note that a long needle or extractor device is capable of being disposed through the conduit of drive shaft 33 for introducing fluid into a receptacle and taking fluid from the receptacle.

The present invention is described above with reference to preferred embodiments. However, those skilled in the art will recognize that changes and modifications may be made in the described embodiments without departing from the nature and scope of the present invention. For instance, although engine 33 is preferred and new and useful, other engine forms capable of delivering agitating impulse to drive shaft 33 can be used. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A mixer comprising:

a receptacle;

a drive shaft having an open proximal extremity disposed outboard of the receptacle, and an open distal extremity disposed in the receptacle;

at least one agitator element attached to the drive shaft proximate the open distal extremity;

a conduit through the drive shaft extending from the open proximal extremity to the open distal extremity for conducting material therethrough to and from the receptacle;

radial vanes attached to the drive shaft adjacent the open proximal extremity;

the drive shaft rotated to a chassis having a chamber enclosing the vanes, an inlet leading to the chamber and an outlet leading from the chamber, in which the drive shaft is made to rotate in response to a flow of fluid acting on the vanes passing through the chamber from the inlet to the outlet.

2. The mixer of claim 1, further comprising an adjustable baffle attached to the chassis capable of regulating a fluid flow through the chamber at one of the inlet and the outlet.

3. The mixer of claim 1, further comprising a fixture securing the chassis to the receptacle.

4. The mixer of claim 1, the at least one agitator element comprising:

a collar attached to the drive shaft; and radial blades pivoted to the collar.

5. The mixer of claim 1, further comprising a fluid pump coupled in fluid communication to the open proximal extremity.

6. A mixer comprising:

a drive shaft having an open proximal extremity, and an open distal extremity;

at least one agitator element attached to the drive shaft proximate the open distal extremity;

a conduit through the drive shaft extending from the open proximal extremity to the open distal extremity;

radial vanes attached to the drive shaft between the open proximal extremity and the open distal extremity;

the drive shaft rotated to a chassis having a chamber enclosing the vanes, an inlet leading to the chamber and an outlet leading from the chamber, in which the drive shaft is made to rotate in response to a flow of fluid acting on the vanes passing through the chamber from the inlet to the outlet.

7. The mixer of claim 6, further comprising an adjustable baffle attached to the chassis capable of regulating a fluid flow through the chamber at one of the inlet and the outlet.

8. The mixer of claim 6, further comprising a fixture securing the chassis to a receptacle.

9. The mixer of claim 6, the at least one agitador element comprising:

a collar attached to the drive shaft; and radial blades pivoted to the collar.

10. The mixer of claim 6, further comprising a fluid pump coupled in fluid communication to the open proximal extremity.

* * * * *